United States Patent [19]

Rech et al.

[11] 4,354,717

[45] Oct. 19, 1982

[54] PROCESS FOR THE PRODUCTION OF GAS DISCHARGE LAMPS

[75] Inventors: Werner Rech, Taunusstein; Wolfgang Welsch, Wiesbaden; Josef Zimlich, Taunusstein, all of Fed. Rep. of Germany

[73] Assignee: Heimann GmbH, Wiesbaden-Dotzheim, Fed. Rep. of Germany

[21] Appl. No.: 889,262

[22] Filed: Mar. 23, 1978

[30] Foreign Application Priority Data

Mar. 28, 1977 [DE] Fed. Rep. of Germany ..... 2713611

[51] Int. Cl.[3] ..... H01J 9/24; H01J 9/38

[52] U.S. Cl. ..... 316/19

[58] Field of Search ..... 316/19; 313/220

[56] References Cited

U.S. PATENT DOCUMENTS

| | | | |
|---|---|---|---|
| 3,088,201 | 5/1963 | Lauden et al. | 313/220 X |
| 3,564,328 | 2/1971 | Bagley et al. | 313/220 |
| 3,628,846 | 12/1971 | Cortorillo | 316/18 X |
| 3,636,398 | 1/1972 | Boyce | 313/116 X |
| 3,923,189 | 12/1975 | Faulkner | 313/220 X |
| 4,052,635 | 10/1977 | Jacobs | 313/220 X |

FOREIGN PATENT DOCUMENTS

| | | |
|---|---|---|
| 764063 | 4/1958 | Fed. Rep. of Germany . |
| 1086351 | 4/1960 | Fed. Rep. of Germany . |
| 2332588 | 10/1966 | Fed. Rep. of Germany . |

OTHER PUBLICATIONS

"Recent Developments in Electronic Flash Lamps", by C. Meyer Phillips Technical Review, vol. 22, Sep. 1961, No. 12, pp. 377–390.

*Primary Examiner*—John McQuade

*Attorney, Agent, or Firm*—Hill, Van Santen, Steadman, Chiara & Simpson

[57] ABSTRACT

A process for producing a gas discharge lamp particularly useful as a flash tube comprising a glass tube, which contains an inert gas with a preformed sintered glass body sealed into each end and containing at least one electrical connector pin of an electrode extending therethrough in a sealed fashion, characterized by providing a glass tube, providing the sintered glass preforms for each end of the glass tube, sealing each of the glass bodies in the respective ends of the glass tube, and filling the glass tube with the desired amount of inert gas prior to completing the formation of all the seals between the glass tube and the glass bodies. The process preferably is accomplished in an apparatus having a chamber which can be evacuated and which can contain a controlled atmosphere at a desired pressure. The process may either form the seals simultaneously while in the chamber which contains the desired pressure of inert gas, or form the seal formed at one end of the glass tube and then form the seal at the other end.

5 Claims, 4 Drawing Figures

PROCESS FOR THE PRODUCTION OF GAS DISCHARGE LAMPS

BACKGROUND OF THE INVENTION

1. Field of the Invention

The present invention is directed to a process or method for producing a gas discharge lamp and particularly a flash tube and at least two electrodes which are connected in a gas tight fashion by an intermediate glass at the ends of the glass tube.

2. Prior Art

A gas discharge lamp which is used for a flash tube is disclosed in an article by C. Meyer, "Recent Developments In Electronic-Flash Lamps", *Philips Technical Review,* Vol. 22, 1960/61, No. 12, pages 377–390. The flash tube such as disclosed in this article in the simplest circumstances may consist of a straight piece of glass tube which has an electrode fused in a gas tight fashion at each end so that an anode is disposed adjacent one end and a cathode is at the other end. Generally, the anode consists of tungsten or molybdenum and the cathode consists of a sintered body which comprises saturating substances that are composed of emission materials and getter materials which are well known and described, for example, in German printed patent AS 23 32 588. The discharge tube or lamp is filled with an inert gas preferably xenon on account of its spectral light distribution, which is similar to natural daylight. An ignition or triggering electrode is generally located on the outside of the tube.

To initiate the gas discharge, the ignition or triggering electrode initiates the gas discharge between itself and the cathode by producing an electrical field which raises as rapidly as possible and, therefore, the gas adjacent the cathode becomes ionized due to the effects of the field and causes a gas discharge to take place. This gas discharge will extend in the direction of the anode until the field strength of the electrical field prevailing between the cathode and the anode becomes of such a magnitude due to displacement of the part of the gas which has not become ionized that the remaining gas is also ionized. Consequently, the main gas discharge between the cathode and anode is triggered. Initiation of the gas discharge can also take place without a separate ignition or triggering electrode if a so-called "overhead ignition" occurs in which the anode receives an adequate voltage pulse.

The glass tube which serves as a discharge vessel consists of quartz crystal glass or hard glass having a very high melting point. The electrode material or at least the material of the metal or metallic electrode connector pins, which passes through a gas tight seal of the glass tube and extends to the actual electrode arranged inside the glass tube, must be selected to be such that the different coefficients of thermal expansion between the material of the electrical connector pin and the glass tube do not lead to cracks in the gas tight connection or seal. When hard glass is used for the glass tube, this matching can be effected by selecting tungsten for the electrodes or at least for the portion of the electrical connector pin extending through the glass envelope and by matching the coefficient of thermal expansion of the tungsten with a hard glass of appropriate composition. It should be noted that matched glass of this type is commercially available.

In case of a quartz crystal glass, a direct matching is not possible. In this instance, as in the case when a hard glass is used in fact for the glass tube, but for economic reasons and primarily to reduce cost, nickel is used as the lead instead of the more expensive tungsten, a transition element composed of an intermediate glass must be provided in order to match different coefficients of thermal expansion.

Although tungsten in combination with a matched hard glass has an advantage in comparison with other metals that no intermediate glass is required, the cost of tungsten is relatively high and tungsten cannot be soldered. A compromise of using expensive metal, which can sustain a high thermal load, only for the actual electrodes, of employing a sintered body for the cathode, and of producing the electrical connector pins for the two electrodes from a cheap metal necessitates utilizing an intermediate glass, which results in an equally expensive solution due to the high cost of the process steps which are required.

In forming the known flash tubes, the first step was sealing the electrical connector pins or supply lines for each electrode in an intermediate glass. For the next stage, two possible processes were available. As disclosed in the above mentioned article from *Philips Technical Review,* the electrode along with its supply line or connector pin, which is in the intermediate glass and serves to support the electrode, is sealed in the opposite end of the glass tube by the immediate glass to the tube, which is provided with its own pump connection. After the sealing operation, the glass tube is evacuated through its own pump connection, subjected to a degassing process, and then filled with a filling or inert gas to the required pressure. After the filling operation, the connection is subsequently fused closed.

One of the other possible ways of forming the tube comprises securing one of the electrodes together with its supply line or connector pin in one end of the glass tube with the sealing forming a gas tight seal, then a second electrode seal in the intermediate glass is positioned in the other end of the tube and the securing of this second electrode is combined with the processes of the evacuation, degasification, and filling and closing of the glass tube. In this case with a straight glass tube, this type of process has many advantages compared to the first mentioned process which required the provision of a separate pump connection of the glass tube.

When using this second process, the second electrode is provided with its supply line or connector pin in a sealed fashion in a so-called glass hose of intermediate glass to form a unit and this unit is inserted into the open end of the glass tube forming the tube of the assembly. The glass tube is substantially longer than the desired final length of the gas discharge lamp. In order to fix the position of the second electrode at a point at which the seal is to be made, the glass tube is slightly impressed or indented by heating this point. Thus, the unit containing the second electrode is loosely received in the glass tube but cannot drop out. The next portion of the process involves subjecting the assembly with one electrode secured and closing one end and the other electrode being in a unit freely received in the glass tube to an evacuation process, followed by a degasification process and then followed by a filling process of the glass tube with the desired inert gas. Each of these processes of evacuation, degasification and filling take place through the open end of the glass tube. After the filling process, a final sealing of the unit comprising the electrode and its supply line is carried out by further heating of the glass tube at the place of the indentation to form the final seal of the end. After forming this second seal at the second end, the excess and superfluous end of the glass tube, which is an excess of the desired length, is cut off, and the step of cutting can be done in one operation with the sealing and closing of the end of the tube.

This second process has the advantage that the separate pump connection is not necessary because one end of the glass tube serves automatically for this purpose; however, the process does have the disadvantage that quite a lot of glass is wasted. Another disadvantage resides in the fact that the exact position of the second electrode cannot be fixed within close tolerances. Therefore, a desired spacing between the two electrodes cannot be accurately achieved. In addition to these disadvantages, both of the above mentioned processes have the disadvantage that the securing of the electrode feed lines with the intermediate glass involves expensive glass blowing operations.

SUMMARY OF THE INVENTION

The present invention is directed to providing a method which enables a selection of materials for a glass tube and for the electrode supply lines or connector pins, which avoids the disadvantages of different coefficients of thermal expansion and nevertheless enables a simple and inexpensive process for construction of the gas discharge lamp, particularly a flash tube.

To accomplish these tasks, the present invention is directed to a process for the production of a gas discharge lamp, particularly useful as a flash tube, said lamp comprising a glass tube containing at least two electrodes and an inert gas with a preformed sintered glass body sealed into each end of the tube, each of said glass bodies having at least one electrical connector pin of an electrode extending therethrough in a sealed fashion, said process comprising providing the glass tube, providing a preformed, sintered glass body for each end of the glass tube, each sintered glass body having at least one electrical connector pin for an electrode extending therethrough with a gas tight seal, sealing each of the glass bodies in the respective end of the plastic tube, and filling the glass tube with a desired amount of inert gas prior to completing the formation of all the seals between the glass tube and the glass bodies.

Each of the preformed, sintered glass bodies can be cheaply and mechanically produced. For this purpose, a glass powder such as a glass solder is molded in the desired shape and then sintered. The use of the preformed, sintered glass body in accordance with the present invention instead of the known intermediate glasses, eliminates expensive glass blowing operations. A further advantage results in the fact that the manufacturing of the preformed, sintered glass bodies is possible in any desired form with accurate dimensions. The feed lines or connector pins, which provide the mechanical mounts for supporting the actual electrodes in the discharge tube, are sealed into the preformed, sintered glass bodies. This can be accomplished during the production of the glass body by molding the powder around the connector pin and then sintering the powder to form the body.

By utilizing preformed, sintered glass bodies, the glass tube can be provided with its final ultimate length within narrow tolerances. When closing the ends of the glass tube with the sintered glass bodies by means of either a glass solder alone, an adhesive, or a combination of glass solder and an adhesive, the electrodes, which are secured on the glass bodies, will obtain the desired position relative to one another which position is absolutely definite. Due to this, the burning-in period and thus the decisive factor for the illuminous intensity irradiated during gas discharge can be readily and accurately adjusted when the gas discharge lamp is being produced. In addition to this, the use of the glass tube which possesses its final length prior to assembly with the glass bodies provides the advantage that it eliminates the waste of the glass which occurs with the previously known processes.

Another advantageous feature of utilizing the prefabricated or preformed, sintered glass bodies is that the body may be shaped in such a way that it serves not only as a closure for the end of the glass tube and means for mounting the electrode by supporting its connector pin, but also provides mounting surfaces for the gas discharge lamp itself. Thus, the gas discharge lamp can have precisely positioned mounting means or surfaces. If the layer of adhesive for sealing the sintered glass body to the glass tube is extended beyond the layer which is necessary to guarantee impermeability to gas, then a flexible mounting of the glass tube on the glass body is made possible.

The gas tight connection of the sintered glass body to the glass tube can be either an adhesive, which is preferably organic or a glass solder. In addition, an adhesive can be combined with the soldering if so desired. When using glass solder, it is possible to add a material, which absorbs infrared radiation, for example, iron oxide. In order to use the process in accordance with the present invention, the glass solder containing materials, which absorbs infrared radiation, can be melted by using infrared radiation to heat the solder to the melting point from a preheated temperature, which is lower than that necessary for melting the solder.

It is also advantageous in particular with regard to adjusting the burning period to utilize the end surfaces of the tube ends for the soldering or adhesive surfaces in forming the seal with the glass body.

Finally, the sintered glass body can advantageously be composed of several layers having various coefficients of thermal expansion. Due to this construction, the thermal adaptation of the selected glass tube to the material of the electrode connector pin is even better or rather the choice is made easier. The sintered glass bodies themselves can also be made of soldering glass. Additional electrodes, for example, for assisting the ignition or triggering of the device or for gettering, can be passed through the sintered glass bodies. In this case, the ignition electrode proper, which is externally attached to the glass tube, would not be necessary.

An essential advantage of the present invention is that several gas discharge lamps can be simultaneously produced. The actual assembly of the gas discharge lamps takes place in a pressure vessel preferably made of steel, which vessel can maintain a controlled atmosphere. By utilizing such a vessel, the vessel may be evacuated to evacuate each of the discharge lamps therewith instead of individually evacuating each discharge lamp. That is to say that the pressure vessel is evacuated and thus the discharge lamps which have been inserted into the vessel but have not yet been closed or provided with a gas tight seal are also evacuated. The utilization of this pressure vessel enables also the degasification and the filling of each of the tubes.

The forming of the seals between the sintered glass body and each end of the tube can be performed either simultaneously or sequentially. In a sequential operation, the sintered glass body, which has been prefabricated and already has been supplied with the electrode connector pin and electrodes, are placed upon a plate or in appropriately formed depressions in a plate. Each of the glass bodies has a glass tube placed thereof and with a glass solder either in the form of a preformed ring or having been applied as a solder paste by a silk screening process disposed on the soldering surfaces of the tube and sintered glass body. The glass solder is then heated to melt and thus forms a gas tight seal or connection between the sintered glass body and one end of the glass tube. The heating step can be accomplished in several ways. In one of the embodiments, the plate is constructed of a resistance material preferably graphite and is provided with electrical connections. By applying an electrical current, which flows through the plate and causes heating of the plate, the plate heats the sintered glass body situated thereon together with the glass solder and the glass tube, until the glass solder melts. Another possibility consists of heating the glass solder by using infrared radiation from an infrared lamp. For this purpose, the glass solder was provided with an additive preferably iron oxide to absorb the infrared radiation. While the solder may be heated to the melting point from room temperature, preferably the glass body, solder and tube have been preheated to a temperature which is below the melting point and the infrared lamp is utilized to heat the solder to above the melting point.

While the above mentioned forming of the seal between one end of a glass solder may be accomplished in any atmosphere, it is desirable to place the plate with the body and the tubes asssembled thereon in the pressure vessel, which can have a controlled atmosphere. By using the pressure vessel and conducting the heating step in the evacuated vessel, the scaling of the electrodes during the heating step is prevented.

In order to close the glass tube at the other end and to complete the gas discharge lamp, the principles are the same as they have been for closing the first end. Prior to heating, the plate is placed inside the pressure vessel, which is then sealed to be airtight and evacuated. Following the evacuation, an inert gas such as xenon which is used for the filling gas of the flash tubes is then placed in the pressure chamber. Then the heating may take place in a manner similar to that described for forming the first seal between the first end and glass body so that the glass solder is melted and forms a gas tight seal between the other end of the tube and glass body to close the tube.

In accordance with the invention, prior to filling with the filling gas or inert gas, the heating step is accomplished by means of heating to a temperature, which is below that which melts the gas solder to degas the electrodes. Such a heating can be carried out either by applying a current to the heating plate, by utilizing infrared radiation, or even utilizing heating coils, which directly heats the pressure vessel together with its contents and thus also degasses the vessel.

Additional advantages may occur when both ends of the tube are simultaneously sealed to their respective glass bodies. This is accomplished in the case of a straight glass tube by placing a sintered glass body for each of the discharge lamps on a first plate, by putting a glass tube in an inverted vertical position on each of the sintered glass bodies, by placing a second sintered glass body for the second closure on the open end of the tube, and by utilizing a second plate to hold the second glass body in place. This entire assembly of two plates, two glass bodies and one glass tube for each of the lamps is then inserted into the pressure chamber. When U-shaped gas discharge lamps are being formed, both the glass bodies can be placed on the same plate and the glass tube is then put in an inverted position with each of its ends receiving a glass body. In either case, the assembly is placed in a pressure chamber, evacuated, heated for degassing the electrodes, and then further heated to a higher temperature necessary to melt the solder to form a seal at each end simultaneously.

DESCRIPTION OF THE PREFERRED EMBODIMENT

Figure 1:
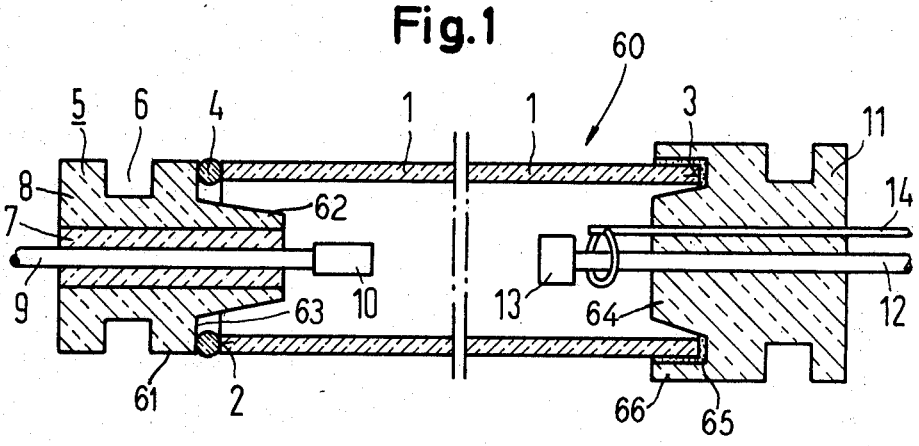
FIG. 1 is a cross section of a gas discharge lamp produced in accordance with the process of the present invention.

The principles of the present invention are particularly useful in a process or method for producing a gas discharge tube or flash tube generally indicated at 60 in FIG. 1. The gas discharge tube 60 includes a glass tube 1 which is composed of either a boron silicate glass, quartz crystal or a glass which is capable of withstanding the temperature load and is transparent to the light produced in the flash tube 60. Preferably, the tube 1 has a circular cross section and is provided with annular end surfaces 2 and 3 at its two ends. It should be noted that while the tube 1 is illustrated as a straight tube, it could be bent in any particular configuration such as U-shaped tube 53 of FIG. 4 or circular-shaped or any other complicated form.

A preformed sintered glass body 5 is secured to an end surface 2 by means for securing such a glass solder 4. The glass solder can be applied to the surface to be soldered such as the end surface 2 as a glass solder ring or by means of a silk screen printing process of a solder paste. The body 5 has a cylindrical outer surface 61 with a conical end projection 62 which was connected by a flat annular surface or shoulder 63. Due to the fact that the outer diameter of the tube 1 and the outer diameter of the surface 61 of the body 5 are substantially the same, the annular shoulder 63 forms a shoulder surface which lies opposite the end surface 2 of the tube 1.

The body 5 is illustrated as having an annular groove 6 which has a rectangular cross section. This groove 6 can serve as means to support the gas discharge tube 60.

The sintered glass body 5 is illustrated as being composed of two concentric layers 7 and 8 which are arranged coaxially within one another. Along the axis of the body 5, an electrical connector pin 9 which is in gas tight sealing relation with the layer 7 is provided and is secured to an anode 10.

The two layers 7 and 8 of the sintered glass body 5 have different coefficients of thermal expansion. This enables the coefficient of theremal expansion of the material of the connector pin 9 and the material of the glass tube 1 to be matched in stages. The continuity of matching produces fewer mechanical stresses during thermal loading. The connector pin 9 preferably consists of an NiFe alloy or an NiFeCo alloy. An anode 10 consisting of tungsten or molybdenum is welded onto the inner end of the connector pin 9. In order to simplify the production process, the connector pin 9 and anode 10 can consist of one single component in which molybdenum is a preferred material for cost reasons. Thus, the connector pin 9 depending on whether it is separate or integral with the anode 10 is constructed of a material selected from a group consisting of NiFe alloy, NiFeCo alloy and molybdenum. Preferably, the common length of the lead or supply line 9 within the sintered glass body 5 is as large as possible. A long fusion path between the body 5 and the connector pin 9 reduces dangers of the formation of hairline cracks.

At its other end surface 3 of the tube 1 and the adjoining end of the peripheral surface of the tube 1, the tube 1 is glued to an appropriately shaped sintered glass body 11 by sealing means comprising an adhesive. As illustrated, the body 11 has a conical projection 64, an annular surface 65 and annular flange 66. Except for the flange 66, the shape of the preformed, sintered glass body 11 corresponds substantially to that of the sintered glass body 5. However, the body 11 is not provided with multiple layers of different materials. In addition, the body 11 supports both a supply line or lead 12 for the cathode 13 and a second supply line 14 which serves as ignition electrode and/or for gettering purposes.

Beyond this exemplary embodiment, other embodiments are possible within the scope of the invention. In fact, the design freedom with regard to the shape of the tube 1 and the shape of the sintered glass bodies 5 or 11 constitutes an important advantage of the gas discharge lamp which can be produced by the method of the present invention. Even in the case of a complicated shape of the tube 1, no separate pump connection components are required for pumping out the tube 1 or filling the tube 1 with a filling gas because the gas tight seal including the insertion of the electrodes can be carried out at one single location is consecutive processes.

Figure 2:
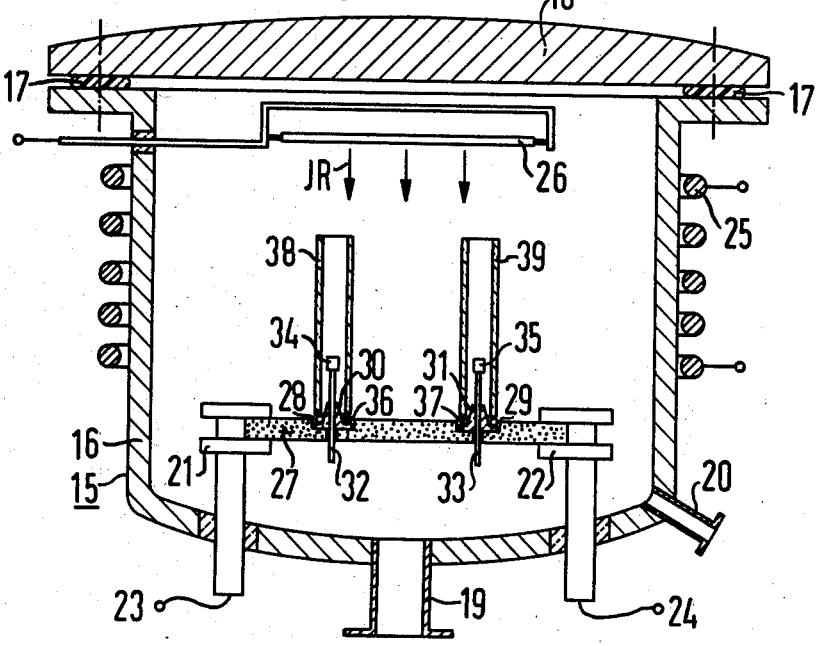
FIG. 2 illustrates an apparatus for receiving a glass tube with a glass body at one end to perform one step of the process of the present invention.

As best illustrated in FIG. 2, a plurality of the glass tubes can be joined to their respective preformed, sintered glass body in a controlled atmosphere by being inserted in a pressure vessel 15. As illustrated, the pressure vessel 15, which is preferably made of steel, includes a container 16 for receiving the tubes and a tight fitting cover 18, which is sealed on the container 16 by an annular seal 17. The container 16 is provided with a connection 19 for evacuating the interior thereof and a connection 20 for admitting a filling gas, such as the inert gas. Two mounting supports 21 and 22, which have electrical connections 23 and 24, respectively, extend through a bottom portion of the container 16 and are electrically insulated therefrom. In addition to the supports 21 and 22, the container 16 is provided with a heating coil 25, which has electrical connections and surrounds the exterior of the container 16. In addition to these, an infrared light 26 is mounted adjacent a top of the container 16 and has an electrical connection passing through a sidewall of the container 16.

The supports 21 and 22 support a plate 27, which has several depressions 28 and 29 (only two are illustrated). In the depressions 28 and 29, sintered glass bodies 30 and 31, respectively, are inserted with their electrode connector pins 32 and 33 extending through apertures in the plate 27. Each of the connector pins 32 and 33 are sealed in their respective body 30 and 31 and support electrodes 34 and 35, respectively. Each of the glass bodies 30 and 31 receives a glass tube with the glass tube 38 being assembled with a glass solder ring 36 on the body 30 while the glass tube 39 is assembled with a soldering ring 37 on the glass body 31. The plate 27 is made of a resistance material, for example graphite, so that by passing current from leads 23 to 24, the plate will heat up to heat the bodies 30 and 31, the glass solder rings 36 and 37 and the tubes 38 and 39.

As illustrated in FIG. 2, a process for forming a seal between one end of the tube such as 38 or 39 with its respective glass body 30 or 31 is accomplished in the following manner. While the vessel 15 can be opened, it is preferably closed and evacuated. By supplying current to the connections 23 and 24, the graphite plate 27 is heated and thus the sintered glass bodies 30 and 31, the soldering rings 36 and 37 are heated until the solder melts and forms a gas tight closure between each of the sintered glass bodies and the end of the glass tube assembled thereon. An alternate way of heating is to supply the heat via infrared lamp 26. Furthermore, when the pressure vessel 15 is closed, degasification of the electrodes 34 and 35 can be carried out by baking out the closed vessel 15 via the heating coil 25. This baking out can be accomplished preferably at a temperature below the temperature necessary to melt the glass solder preforms 36 and 37.

Figure 3:
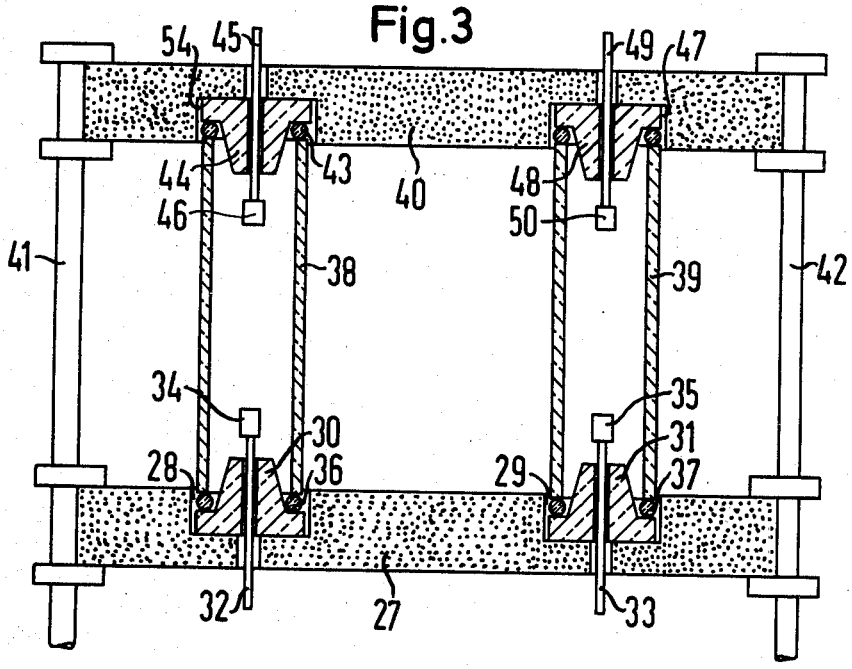
FIG. 3 illustrates a holding device for simultaneously forming the seals between each end of the glass tube and its respective sintered glass bodies.

In FIG. 3, a device, which includes the plate 27 and an additional second plate 40, is illustrated. The plate 40 is kept above the plate 27 by additional common mounting supports 41 and 42. The plate 40 has depressions 54 and 47, which face the depressions 28 and 29 in the plate 27 and are aligned therewith. As illustrated, two gas discharge tube assemblies are positioned between the plates 27 and 40. For example, a sinter glass body 30 with a solder ring 36 is received in the depression 28 and receives one end of a glass tube 38. The other end of the glass tube 38 supports a second soldering ring 43 and a sintered glass body 44, which has an electrode lead 45 for electrode 46 sealed therein. As illustrated, the other depression 29 receives the glass body 31, a solder ring 37, one end of the glass tube 39 whose other end receives a solder ring, a glass body 48, which has the electrode lead 49 with electrode 50 sealed therein. The arrangement in FIG. 3 can be utilized to seal a glass body in the other end of the tube after forming the seal as illustrated in FIG. 2 or both glass bodies such as 30 and 44 can be sealed to the ends of the tube 38 simultaneously.

Figure 4:
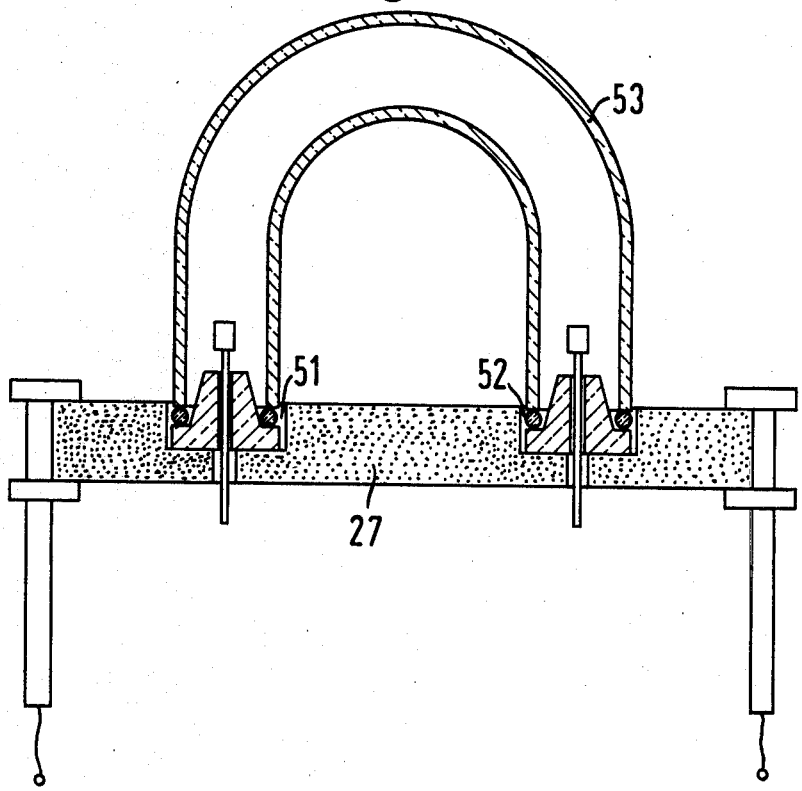
FIG. 4 is a device illustrating forming a seal simultaneously at each end of a U-shaped discharge tube and its respective glass bodies.

In FIG. 4, a single plate 27 is illustrated and has two depressions 51 and 52, which receive glass bodies. The U-shaped glass tube 53 is placed with its ends receiving the glass bodies in the depressions 51 and 52.

When utilizing either the frame in FIG. 3 or the arrangement in FIG. 4, completing the closure of the discharge lamp is accomplished in the following manner. The arrangements are disposed in the chamber 16 of the vessel 15. Preheating, for example, preheating to 500° C., is accomplished simultaneously with evacuation of the vessel 15 to a pressure of, for example, $10^{-1}$ to $10^{-3}$ Pascal. At this temperature and vacuum, a reliable degasification of the electrodes is ensured. After the degasification, a filling gas is introduced to the desired pressure, which can be between a few Pascals to 10 bars and can be maintained with precise tolerances for each of the gas discharge lamps being produced at the same time. By subsequently heating to a temperature of approximately 800° C., the soldering occurs to form the seal between the other end and the glass body such as 44 disposed therein. In the event both glass bodies such as 30 and 44 are to be secured simultaneously, the heating causes the melting of the glass solders at each end to form the seal with the glass bodies.

The process in accordance with the present invention provides a high economy because just a few individual process stages or steps are required. In addition, the process enables a wide selection of the choice of material to be utilized for each of the gas discharge lamps.

Although various minor modifications may be suggested by those versed in the art, it should be understood that we wish to embody within the scope of the patent warranted hereon, all such modifications as reasonably and properly come within the scope of our contribution to the art.

We claim:

1. A process for a simultaneous production of a plurality of gas discharge lamps particularly useful as flash tubes, each lamp comprising a glass tube containing at least two electrodes and an inert gas with a preformed, sintered glass body sealed into each end of the tube, each of said bodies having at least one electrical connector pin or an electrode extending therethrough in a sealed fashion, said process comprising providing a plurality of the glass tubes, providing a preformed, sintered glass body for each end of the glass tube, each sintered glass body having at least one electrical connector pin for an electrode extending therethrough with a gas tight seal, and then simultaneously sealing each of the glass bodies in the respective end of each glass tube and filling each glass tube with the desired amount of inert gas prior to completing the formation of the seals between the ends of each glass tube and the glass bodies, the step of sealing and filling including soldering by providing a glass solder between the glass body and the end of its tube, and heating the solder to cause melting of the glass solder to form a solder seal and including applying an additional material between at least one of the glass bodies and the end of its glass tube to secure the one body to the glass tube in addition to soldering.

2. A process for a simultaneous production of a plurality of gas discharge lamps particularly useful as flash tubes, each lamp comprising a glass tube containing at least two electrodes and an inert gas with a preferred, sintered glass body sealed into each end of the tube, each of said bodies having at least one electrical connector pin of an electrode extending therethrough in a sealed fashion, said process comprising providing a plurality of the glass tubes, providing a preformed, sintered glass body for each end of the glass tube, each sintered glass body having at least one electrical connector pin for an electrode extending therethrough with a gas tight seal, assembling a preformed, sintered glass body in each end of each glass tube, providing a plate having at least one depression to receive a preformed, sintered glass body for each one of the glass tubes being formed, said plate being of a material consisting of a resistant material, preferably graphite and having electrical connectors for passing a current therethrough, placing the glass tubes on the plate with at least one glass body of each tube being received in a depression in the plate to support the tube and the associated glass bodies, and then simultaneously sealing each of the glass bodies in the respective end of each glass tube and filling each glass tube with the desired amount of inert gas prior to completing the formation of the seals between the ends of each glass tube and the glass bodies, said step of sealing and filling including providing glass solder between the end of each glass tube and its associated glass body and heating the glass solder to melt the solder to form a gas-tight seal between each glass body and its respective end of its respective glass tube, said step of heating including passing a current through the plate to cause heating of each of the glass bodies disposed in the depressions thereof.

3. A process according to claim 2, wherein the plate having the glass bodies with the tubes disposed thereon is disposed in a pressure chamber, and wherein prior to heating to form the seal between each of the bodies and its tube, the process includes evacuating the pressure chamber, degasifying the electrodes by heating the plate to a temperature less that necessary to melt the solder.

4. A process for a simultaneous production of a plurality of gas discharge lamps particularly useful as flash tubes, each lamp comprising a glass tube containing at least two electrodes and an inert gas with a preformed, sintered glass body sealed into each end of the tube, each of said bodies having at least one electrical connector pin of an electrode extending therethrough in a sealed fashion, said process comprising providing a plurality of the glass tubes, providing a preformed, sintered glass body for each end of the glass tube, each sintered glass body having at least one electrical connector pin for an electrode extending therethrough with a gas tight seal, providing a plate having at least one depression to receive a preformed, sintered glass body for each one of the glass tubes being formed, said plate consisting of a resistant heating material preferably graphite having electrical connections for applying current thereto, assembling a preformed, sintered glass body in each end of each tube, placing the glass tubes on the plate with at least one glass body of each tube being received in a depression in the plate to support the tube and its associated glass bodies, then simultaneously sealing each of the glass bodies in the respective end of each glass tube and filling each glass tube with the desired amount of inert gas prior to completing the formation of the seals between the ends of each glass tube and the glass bodies, the step of sealing and filling included providing glass solder between the end of each glass tube and its associated glass body, inserting the plate, the glass bodies and tubes into a tight chamber, evacuating the chamber, heating to a temperature lower than that required to melt the glass solder by applying a current to heat said plate to said temperature to degass the electrodes, and then heating the glass solder to melt the solder to form a gas-tight seal between each glass body and its respective end of its respective glass tube.

5. A process for simultaneous production of a plurality of gas discharge lamps particularly useful as flash tubes, each lamp comprising a glass tube having a U-shape and containing at least two electrodes and an inert gas with a preformed, sintered glass body sealed into each end of the tube, each of said bodies having at least one electrical connector pin of an electrode extending therethrough in a sealed fashion, said process comprising providing a plurality of the glass tubes each having a U-shape, providing a preformed, sintered glass body for each end of the glass tube, each sintered glass body having at least one electrical connector pin for an electrode extending therethrough with a gas tight seal, providing a plate having two depressions to receive the two preformed, sintered glass bodies for each one of the glass tubes being formed, assembling the glass bodies and tubes on the plate with each U-shaped tube having a glass body at each end of the glass bodies of each tube being received and supported in depressions of said plate, and then simultaneously sealing each of the glass bodies in the respective end of each glass tube and filling each glass tube with the desired amount of inert gas prior to completing the formation of the seals between the ends of each glass tube and the glass bodies, said step of sealing and filling includes providing glass solder between the end of each glass tube and its associated glass body and heating the glass solder to melt the solder to form a gas-tight seal between each glass body and its respective end of its respective glass tube.

* * * * *